US006030109A

United States Patent [19]

Lobsenz

[11] Patent Number: 6,030,109

[45] Date of Patent: Feb. 29, 2000

[54] GOLF SCORING SYSTEM

[76] Inventor: Charles B. Lobsenz, 18 Canyon Crest Ct., Frisco, Tex. 75034

[21] Appl. No.: 08/851,120

[22] Filed: May 5, 1997

[51] Int. Cl.[7] ..... G06F 17/00

[52] U.S. Cl. ..... 364/411.1; 473/407; 340/323 R

[58] Field of Search ..... 473/151, 152, 473/199, 224, 223, 222, 221, 225, 220, 219, 407, 409, 283; 364/410.1, 411.1; 340/323 R; 434/247; 273/DIG. 26

[56] References Cited

U.S. PATENT DOCUMENTS

| | | | |
|---|---|---|---|
| 3,784,207 | 1/1974 | Gentiluomo . | |
| 4,156,190 | 5/1979 | Chittenden et al. | 324/175 |
| 4,331,918 | 5/1982 | Dunch | 324/174 |
| 4,371,945 | 2/1983 | Karr et al. | 364/561 |
| 4,625,113 | 11/1986 | Zierhut | 250/338 |
| 4,835,435 | 5/1989 | Yeung et al. | 310/324 |
| 4,933,589 | 6/1990 | Strubbe | 310/323 |
| 5,029,866 | 7/1991 | Beard, III et al. . | |
| 5,246,232 | 9/1993 | Eccher et al. . | |
| 5,395,116 | 3/1995 | Blaakman . | |
| 5,609,534 | 3/1997 | Gebhardt et al. . | |

*Primary Examiner*—Michael O'Neill
*Attorney, Agent, or Firm*—Hunton & Williams

[57] ABSTRACT

A golf scoring system is provided in which one or more sensors are positioned in close proximity to the location where a golf club strikes a golf ball in connection with a golf shot. Additionally, a receiver/display device is provided so as to be in periodic communication with the one or more sensors. Thus, when a player makes a shot, and thus contacts the golf ball with a golf club, the aforementioned sensors detect the shot and relay information pertaining to that shot to the receiver/display. The receiver/display, upon receiving the information, processes the information and displays it for view by the one or more golfers playing the round. The same information may also be transmitted to a central location or to other specific locations for centralized, real-time display of golf score, pace and current hole information.

20 Claims, 6 Drawing Sheets

GOLF SCORING SYSTEM

FIELD OF THE INVENTION

This invention relates generally to the game of golf and more particularly to a device and method for automatically counting the number and types of strokes taken by a player during the course of a round of golf and for processing, displaying and transmitting information based upon such count either in real time or after play has concluded.

BACKGROUND OF THE INVENTION

The game of golf spans a long and distinguished history. Golf is played by individuals from all walks of life and continues to gain popularity with each passing day. While once the province of wealthy middle aged males who were members of expensive and exclusive country clubs, the game of golf is now enjoyed by men and women and young and old alike. It is no surprise that golf is so popular in this day and age. A round of golf is the perfect "getaway" from the hectic lifestyles of today. Golf course availability and accessibility is greater today than ever and many are starting to discover this sport for what it is—a relaxing and refreshing opportunity to be outside, often in beautiful surroundings, and to engage in some healthy competition.

While many golfers simply enjoy hitting the ball and/or spending time with friends, acquaintances or business contacts, there are others who are more competitive and consider their performance, and thus their score, to be the primary motivating factor for continuing to play the game. For these competitive types as well as for the occasional golfer who likes to monitor his or her progress toward becoming a better golfer, it is important to keep score during the game. As any golfer knows, the golfer with the lowest score (or number of strokes) is generally the winner of the golf round or tournament. In some circumstances, however, handicaps are used to allow for a better challenge when two or more golfers of disparate abilities play in the same round. In any event, it is generally necessary to keep track of the number of strokes taken for each hole and for the complete round when any sort of competition is involved or if a golfer merely wants to keep track of his or her performance.

Typically, prior to beginning a golf round, the golfers are supplied with a scorecard in order to keep track of their score. One or two players are typically designated or volunteer to be the scorekeeper for the round. The duties of the golf scorekeeper requires such person to poll all golfers upon completion of each hole regarding what their score was for the particular hole. For the normal round of 18 holes, this occurs 18 times and at the end of the round, the scores for each of the holes are totaled to compute each player's score for the round.

There are a number of drawbacks to this method of keeping score. First, in many cases, the scorekeeper, otherwise caught up in the beauty of the course, his or her last shot or some other distraction, may forget to poll the golfers at the end of the particular hole. It may not be until one or more strokes into the next hole or even a hole thereafter that the scorekeeper realizes that he forgot to ask his companions for their scores. By that time, memories can often be faulty and the actual score may not be finally reflected on the scorecard. Similarly, a player, himself may forget the number of strokes taken during a particular hole. A second drawback to the prior art method for keeping score is the fact that there is no verification of scores attained. While the casual golfer is less concerned with his companions' scores and more concerned with his own performance, in a competition (perhaps involving wagering or prizes), disagreements may arise regarding a particular player's score on a particular hole. While golf is known as a gentleman's game and honor and trust is generally the rule, there are those who may be inclined to report their score incorrectly for various reasons. Yet another drawback to the manual score keeping of the prior art is the requirement for scorecards and pencils. Pencils and/or scorecards may be lost along the way during a round of golf (especially on windy days) leaving the players with no place to keep their scores other than in their memories. Additionally, the cost of scorecards and pencils, while not a major expenditure for the course management, is still yet another cost in connection with running a golf course.

Another problem associated with the prior art method of keeping score is that persons (e.g. other player's in a different foursome, a tournament director, spectators or a golf marshall) who are interested in golfers' scores or progress as they are being attained must accompany the golfers or someone else must accompany the golfers and manually report scores to a central location. This is not the optimum situation especially in a small golf tournament (presuming that TV coverage is not available). Thus, players (or other interested parties) can not typically be kept abreast of their competitors ongoing scores as the round is played. Instead, all players must meet when everyone has concluded their round and then determine who is the winner.

SUMMARY OF THE INVENTION

It is thus a primary object of the present invention to provide a method and system for overcoming the above-mentioned drawbacks associated with the prior art method of score keeping associated with a round of golf.

It is another object of the present invention to provide a method and system for automating the score keeping task in a game of golf.

It is yet another object of the present invention to insure that an accurate record of the scores of the golfers is available both during and after a round of golf.

It is still yet another object of the invention to provide a method by which an interested third party may be made aware of one or more golfer's scores in real-time without physically accompanying the golfers.

It is still another object of the invention to decrease the cost incurred by golf course management in providing golf facilities by eliminating the need for paper scorecards and pencils.

It is a yet further object of the present invention to provide for automatic gathering, processing and storage of statistical information concerning golfers and the courses that they play on.

In accordance with the foregoing objects of the invention, a golf scoring system is provided in which one or more sensors are positioned in close proximity to the location where a golf club strikes a golf ball in connection with a golf shot. Additionally, a receiver/display device is provided so as to be in periodic communication with the one or more sensors. Thus, when a player makes a shot, and thus contacts the golf ball with a golf club, the aforementioned sensors detect the shot and relay information pertaining to that shot to the receiver/display. The receiver/display, upon receiving the information, processes the information and displays it for view by the one or more golfers playing the round. As further discussed herein, in addition to displaying the information locally for the player to view, the same information may also be transmitted to a central location or to other specific locations according to the teachings of the present invention.

According to a preferred embodiment of the invention, the sensor is a sound sensing device which detects the sonic pattern of a golf club striking a golf ball. A sensor is preferably located on a lower leg or shoe of each golfer so as to be in close proximity to the point of contact between the golf ball and the golf club. Additionally, in the preferred embodiment, the receiver/display unit is located on a golf cart for viewing by the players as necessary.

As will be further discussed below, the novel invention herein may be applied in various other circumstances and environments so as to achieve the advantages offered by the invention in different situations. The foregoing summary has outlined some of the more pertinent objects of the present invention. These objects should be construed to be merely illustrative of some of the more prominent features and applications of the invention. Many other beneficial results can be obtained by applying the disclosed invention in a different manner or by modifying the invention as will be described. Accordingly, other objects, benefits and configurations of the invention may be had by referring to the following Detailed Description of the Invention.

BRIEF DESCRIPTION OF THE DRAWINGS

For a more complete understanding of the present invention and the advantages thereof, reference should be made to the following Detailed Description of the Invention taken in conjunction with the accompanying drawings in which:

FIG. 2(*c*) is a block diagram illustrating the components comprising the sound sensor/transmitter in a preferred embodiment of the present invention;

DETAILED DESCRIPTION OF THE INVENTION

Figure 1:
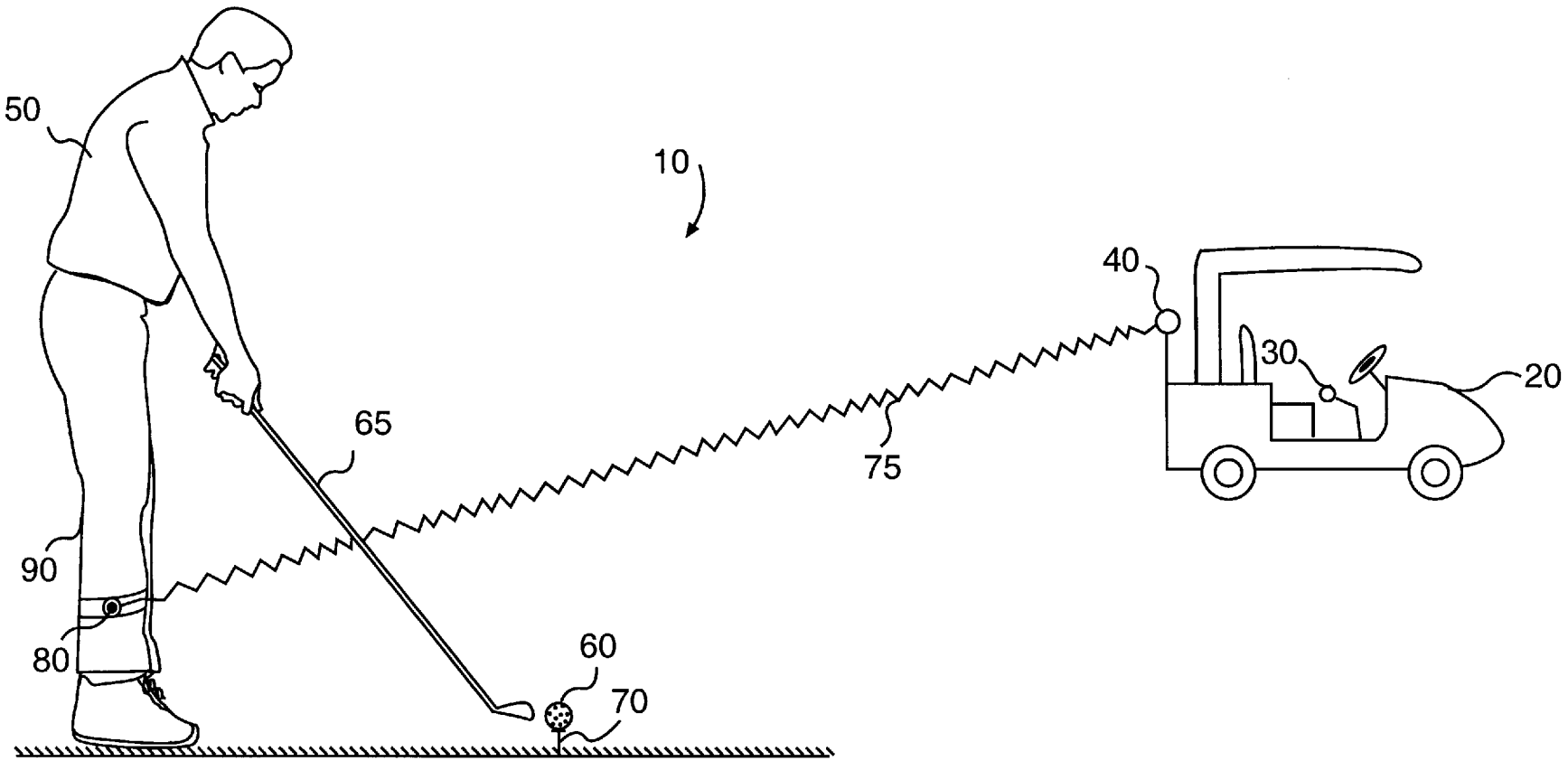
FIG. 1 illustrates a preferred embodiment of the golf scoring system of the present invention, FIG. 2(*a*) is a detailed view of the sound sensor/transmitter component of the golf scoring system in accordance with the present invention.

An overall view of the golf scoring system (GSS) 10 of the present invention is illustrated in FIG. 1. As can be seen therein the GSS includes two primary components. The first component of GSS 10 is sound sensor/transmitter (SST) device 80 which is preferably located on the lower leg 90 of golfer 50 proximate to the ankle. SST 80 may be positioned at or near the ankle of golfer 50 using a suitable metal, VELCRO or elastic band to attach SST 80 to golfer 50. It is only necessary that SST 80 be in relatively close proximity to tee 70 and golf ball 60 so that when golfer 50 takes a stroke, the resulting sonic pattern may be detected. The second major component of GSS 10 is receiver/display unit (RDU) 30 which is positioned on golf cart 20 so that it is within easy view of golfer 50 and/or his playing partner. Alternatively or additionally, RDU 30 may comprise a wristwatch configuration to be worn on the wrist of golfer 50 and which displays all or a subset of the information displayed on the golf cart RDU 30. SST 80 and RDU 30 preferably communicate with each other over an appropriate RF frequency link 75 so as to achieve the objects of the present invention. In particular SST 80 functions so as to detect the sound occasioned by golf club 65 striking golf ball 60 in connection with golfer 50 taking a stroke. As will be discussed in further detail below, it is not a requirement of the present invention that SST 80 be located on golfer's leg 90. Alternatively, SST 80 may be attached to the shoe of golfer 50 or on the lower shaft of golf club 65 or in any other position that places SST 80 in relatively close proximity to the point of impact between golf club 65 and ball 60. This is preferable so that SST 80 can distinguish between strokes taken by the golfer 50 wearing SST 80 and strokes taken by other players as well as background noises. It will also be understood by those of skill in the art that other transducers may be substituted for the sound sensor including, without limitation, impact sensors (on the golf club) or optical sensors.

Golf cart 20 is fitted with antenna 40 which is used to receive data which is transmitted by SST 80. In addition, the data, once received by antenna 40, is relayed to RDU 30 through a coaxial or other communication cable which is run on golf cart to terminate at RDU 30. Alternatively, antenna 40 may be a flexible rubber antenna ("rubber ducky") or small metallic antenna attached directly to RDU 30 without the need for cabling. According to this arrangement, anytime golfer 50 takes a stroke in which he contacts ball 60, SST 80 can detect the same and relay information indicating that a stroke was taken to RDU 30 for display to golfer 50 or his playing partners.

As will be readily recognized by those familiar with the game of golf, it is not necessary that ball 60 be located on tee 70 for this GSS 10 to operate properly and process the stroke. Thus, after teeing off, player will likely take a shot from the fairway or from the surrounding rough without the use of tee 70. Since player strikes ball 60 with club 65 to create the same or a similar sonic pattern in this latter case, SST 80 will detect the stroke as if it were a stroke taken from tee 70. Similarly, if golfer 50 is putting, SST 80 will detect this as well since the putter striking golf ball 60 will make a sound which is also detectable by SST 80 as described below.

It will also be understood that when a player takes practice swings, these will not be detected as countable strokes since there is no contact between ball 60 and club 65. Similarly, strokes taken by other players will not be counted as strokes taken by player 50 since the sonic pattern generated will be outside of the range of detection of SST 80 as is discussed further below.

According to a preferred embodiment of the present invention, each RDU 30 is preferably paired with up to four SSTs 80 which are worn by up to four different players. Each SST 80 may be configured to transmit on an RF frequency different from the other SSTs 80 paired with the particular RDU 30. In this way, RDU 30 can properly distinguish among stroke data originating from each of the up to four players. Alternatively, and as described in further detail below, multiple SSTs 80 may operate on the same RF frequency link 75 but use differing tag data in order to indicate the origin of the message (and thus which golfer is responsible for the stroke).

Figure 2A:
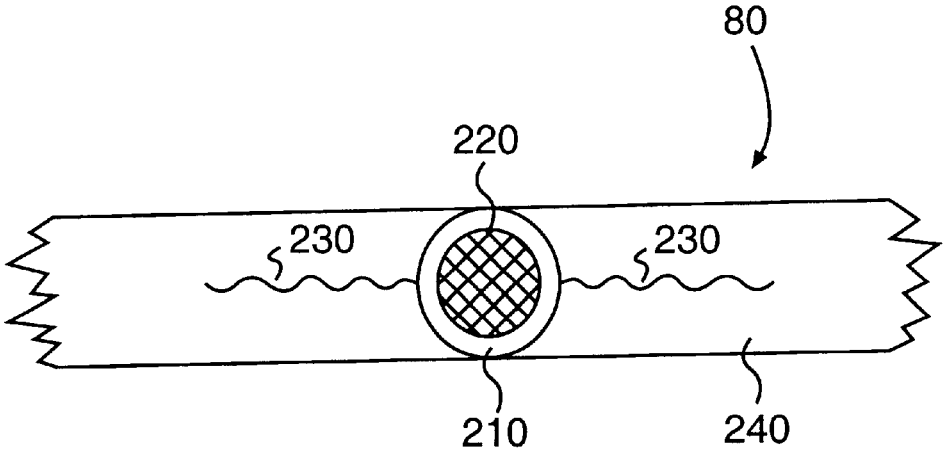
FIG. 2(*b*) is a perspective view showing the sound sensor/transmitter component positioned upon a player's leg in accordance with a preferred embodiment of the present invention.
Figure 2B:
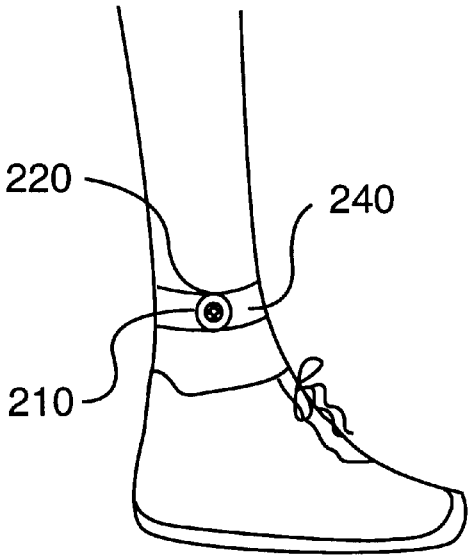
Figure 2C:
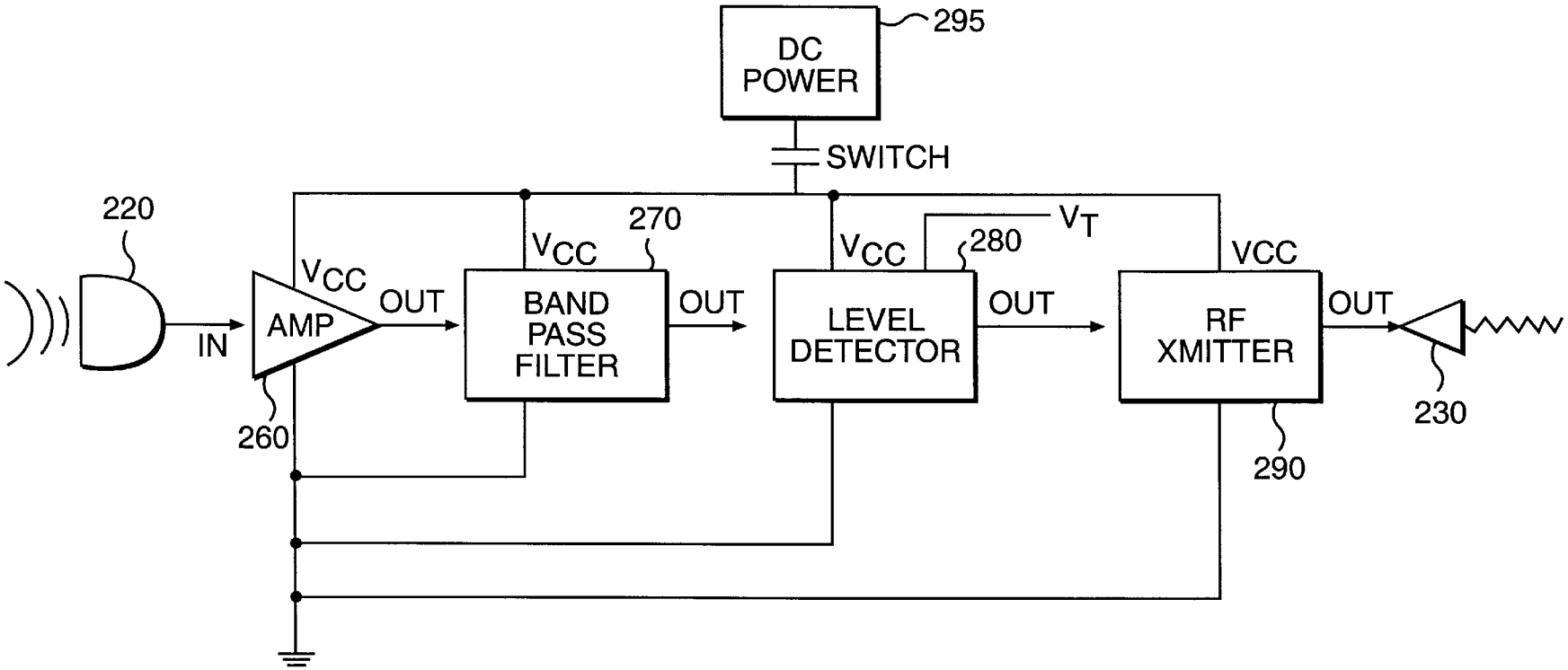

FIGS. 2(*a*), 2(*b*) and 2(*c*) illustrate, in further detail, the SST 80 of the present invention. SST 80 preferably consists of a plastic housing 210 which is fastened to a flexible, adjustable and/or elastic legband 240. Plastic housing 210 contains electronic components (described below in connection with FIG. 2(*c*)) including a piezoelectric microphone 220 and a small DC power source. These components together makeup SST 80 and perform the functions of detecting the sound when club 65 strikes ball 60 and relaying information in connection with that detection to RDU 30. In particular, piezoelectric microphone 220 is known in the art and functions to respond to the specific sound created when club 65 strikes ball 60. As will be understood by those of ordinary skill in the art and as further illustrated in FIG. 2(*c*). piezoelectric microphone 220 may be connected such that its output serves as an input to an amplifier 260.

Turning now to FIG. 2(*c*), the output of amplifier 260 may be further connected to the input of a band pass filter 270 which may be configured as is known in the art so as to have a center frequency corresponding to the center of the frequency range of the sonic emission typically created when club 65 strikes ball 60. In a preferred embodiment of the present invention, band pass filter 270 is configured to detect at least two distinct sounds—a drive/chip (club contacting ball) and a putt (putter contacting ball). As will be easily recognized by golfers and by those of skill in the art, the sonic pattern created by a putt is typically quite distinct from that of a non-putt in that the putt stroke typically emits a higher frequency "ping" like sound. Alternatively, band pass filter 270 may be eliminated and detection may occur solely on the large relative amplitude of the sonic wave of ball contact generated in close proximity to piezoelectric microphone 220. In either case, level detector 280 is preferably included to receive as its input the output of either band pass filter or directly from amplifier 260 as the case may be. Level detector 280 is designed to produce an output voltage pulse each time piezoelectric microphone 220 detects a pulse of sonic energy resulting from a golf shot. Level detector 280 is also configured so as to reject background noises or strokes by other golfers occurring at a distance as triggering events for recording a stroke charged to golfer 50. In a preferred embodiment of the present invention, the pulses appearing at the output of level detector 280 are then transmitted via VHF transmitter 290 and antenna 230 to RDU 30. Although antenna 230 is illustrated in FIG. 2(*a*) in the interest of explanation, antenna 230 is operably connected to the output of transmitter 290 and is preferably positioned internal to legband 240 so as not to be readily apparent to a user from an external point of view.

In an alternative embodiment of the present invention the components connected to microphone 220 may, rather than the above, comprise a simple sound detection circuit as illustrated in FIG. 11-9 (page 238) of "30 Customized Microprocessor Projects" by Delton T. Horn, ISBN 0-8306-0705-6 (1986, TAB BOOKS).

Figure 3:
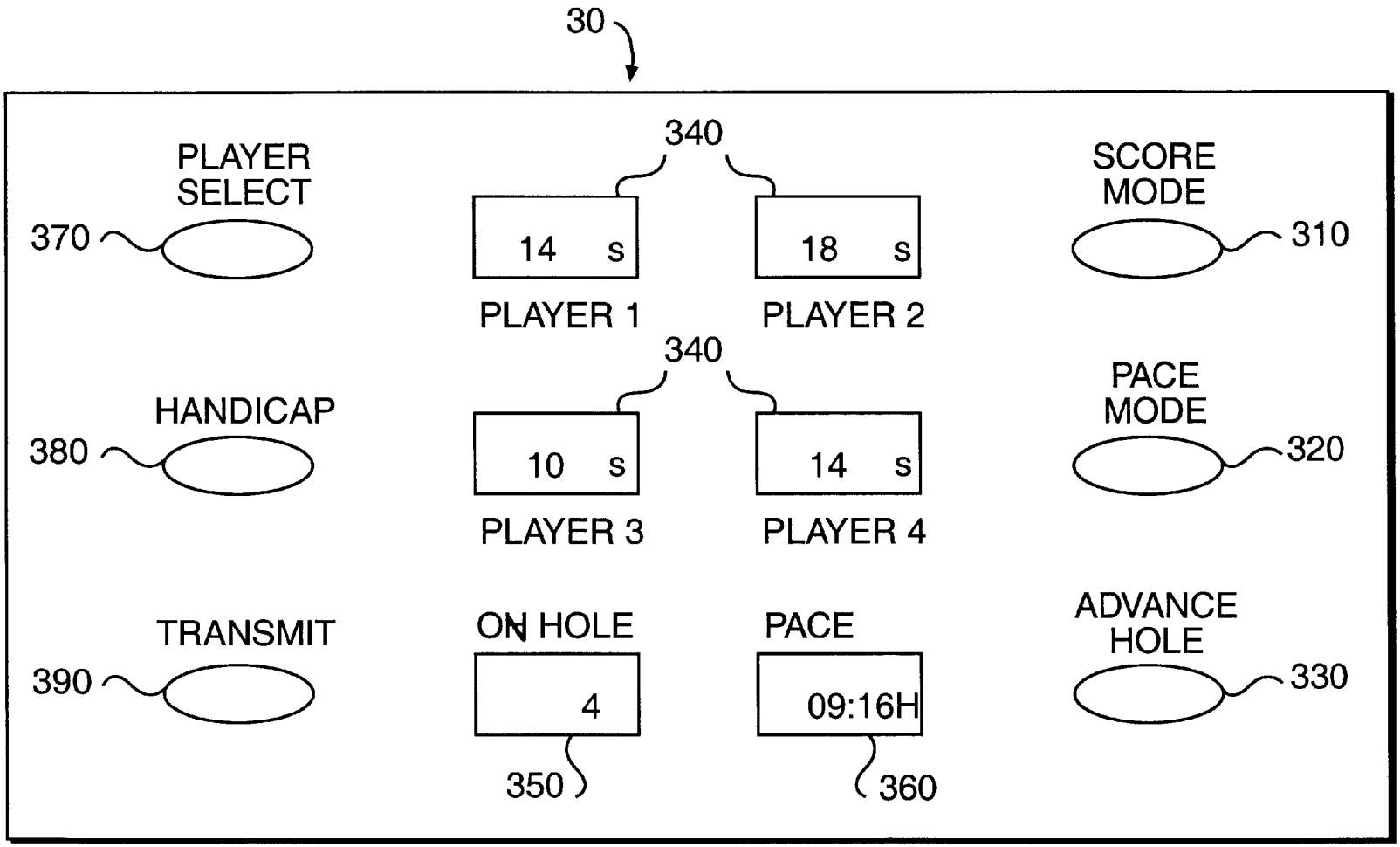
FIG. 3 is a detailed view of the display panel of the receiver/display unit of the golf scoring system in one preferred embodiment of the present invention.

FIG. 3 is an illustration of RDU 30 in one particular preferred embodiment. It will be recognized that departures from the particular layout shown as well as information displayed are possible while still falling within the scope of the present invention. As described above, RDU 30 receives information from one or multiple SSTs 80 and RDU 30 performs four main functions—receiving the data, processing the data, processing user input and displaying information. In the particular display layout shown, player score display areas 340 are provided in order to display up to four players' scores. The player score display areas 340 (as well as the other displays on RDU 30) may be LCD or LED readouts as are known in the art or any other visual display for displaying information to a user. Also provided is current hole display 350 which displays the hole which is currently in play for the group of golfers. This information is determined by RDU 30 as is described below. Additionally, pace display 360 is included on RDU 30 for the purpose of displaying various pacing information relating to the particular round of golf being played. By way of example, pace display may indicate the time elapsed from the first player teeing off on the first hole to the current time. Alternatively, pace display may indicate the time elapsed from tee off of the current hole to the current time. In yet another mode, pace display 360 may display the current clock time.

As illustrated in FIG. 3, RDU 30 includes a series of buttons which may be depressed by a user in order to control the operation of RDU 30. Each of the buttons which are present in the preferred embodiment and as illustrated in FIG. 3 is now discussed. As will be easily recognized, the following description is merely exemplary. Other layouts and information may be implemented using the information gathered through SST 80. For example, while the following description envisions a relatively large RDU 30 to be mounted on a golf cart, a more compact RDU 30 may be used and located on a user's wrist in a wristwatch configuration. In this case, less information would likely be displayed to the user (perhaps only player score display areas 340) than in the case of the below described golf cart mount RDU 30.

Score Mode button 310 is used to select the score mode employed for displaying information in the player score display areas 340. In a preferred embodiment of the present invention, a user may select one of three modes—scratch, handicap, or match play. Player score display areas 340 may be designed to display the currently selected mode. This is illustrated in FIG. 3, for example, by the "S" subscript to the score display in each of the four player score display areas 340 where "S" represents scratch mode. As would be expected, handicap mode may be represented by an "H" indication in player score display areas 340 and match play mode might be represented, for example, using an "M" In scratch mode, player score display areas 340 display the total number of strokes taken by each respective player as they are taken during the round of golf In handicap mode, the player score display areas 340 display the players' scores adjusted for their handicap which is entered as discussed below. In match play mode, the player score display areas 340 display the number of holes won by each player during the round in accordance with standard match play scoring.

One or more player handicaps may be entered through RDU 30 as follows. Player Select button 370 is used to cycle through players 1 through 4 with the currently active player score display area 340 flashing the current display. Next, the Handicap button 380 is depressed and the active player display area 340 will first display a flashing "0". The user may then repeatedly press Handicap button 370 each time increasing the handicap by a value of one. Thus, for example, if a player has a handicap of 15, he would press Handicap button 380 one time to register the "0" and then fifteen more times until his handicap was displayed in his associated player score display area 340 to read "15". Alternatively, the user could hold Handicap button 380 depressed and the handicap may increase at a predetermined rate. After one player's handicap has been entered, others may be entered by simply pressing Player Select button 370 until the desired player is selected for handicap entry.

The next feature to be discussed is the On Hole display 350 and the Advance Hole button 330 which work in tandem. A user, upon completing a hole, may press the Advance Hole button 330 to indicate that the previous hole has been played and the next hole is about be played. Upon pressing the Advance Hole button 330, the On Hole display 350 will be advanced by one hole. Alternatively and preferably, the On Hole display 350 may be advanced automatically without requiring the use of the Advance Hole button 330 by configuring SST 80 to be operable to determine when one hole has been played and a new hole has been started. This is described in detail in connection with FIG. 5, below.

The final exemplary function of RDU 30 to be discussed is Pace Display 360 and the associated Pace Mode button 320 which controls Pace Display 360. Pace Display 360 is dependent upon information generated by the On Hole function in order to operate. Pace Display 360 may, in a preferred embodiment, be set to one of two modes—Hole or Total Elapsed. Other modes are also possible wherein some time display based upon input received from SST 80 is calculated and displayed. In Hole pace mode, the time elapsed from tee off on the particular active hole until the current time is displayed. Thus, in this mode, the display indicates the amount of time spent playing a particular hole at any instant during the play of that hole. The display in this mode is reset either by detecting a manual hole advance or an automatic hole advance as is described below in connection with FIG. 5.

The Transmit button 390 is discussed in connection with overall system operation below. However, in general terms, the Transmit button 390 functions to either download or transmit information stored and/or calculated in RDU 30 to a local database kept at the golf course, to another RDU 30 or to a remote database located at a central site. Additionally, it is possible to add other buttons such as a manual stoke adjustment button (either up or down) in case a stroke is, for one reason or another, erroneously detected or not detected or if a player wishes to take a mulligan.

Figure 4:
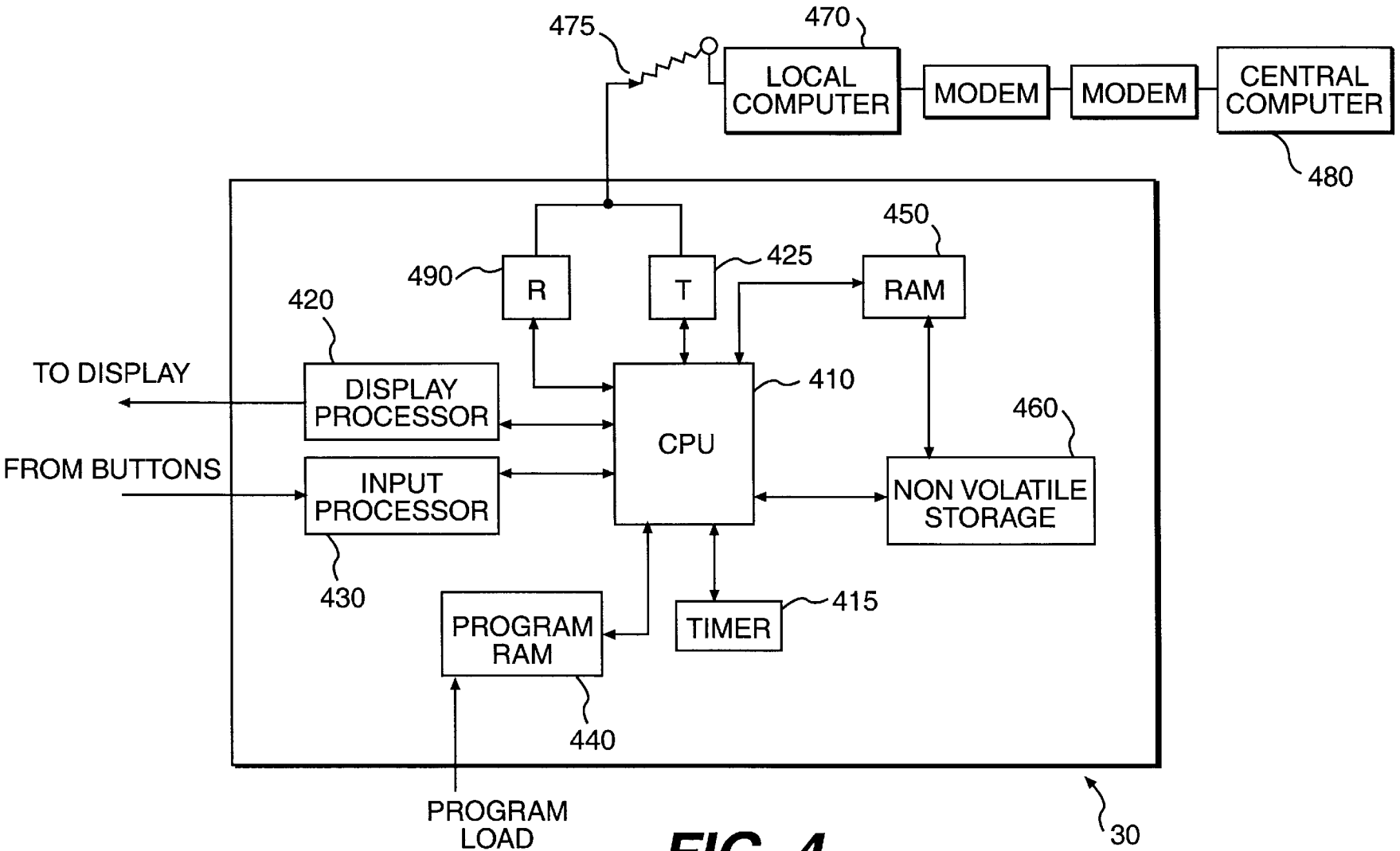
FIG. 4 is a block diagram illustrating the structure and function of the receiver/display unit and its interface with a local computer and a remote computer.

FIG. 4 is a block diagram illustrating the preferred embodiment of the functionality contained within RDU 30 and it interface to a local computer 470 and/or a central computer 480. RDU 30 comprises a number of components which collectively serve the primary functions of (i) receiving data transmitted from SST 80; (ii) processing such data, (iii) displaying the processed data for a user, and (iv) offloading data received and processed to one or more external computers or one or more other RDUs. The heart of RDU 30 is central processing unit (CPU) 410 which may be an appropriate microprocessor as is known in the art. CPU 410 is responsible for control of all of the operations performed by RDU 30. Additionally, input processor 430 communicates with CPU 410 providing it with data received from buttons 310, 320, 330, 370, 380 and 390. In this fashion, user inputs may affect operation of RDU 30 as programmed. Alternatively, it is also possible to include input processor 430 functionality within CPU 410.

In connection with such programming, program RAM 440 is preferably included and is in communication with CPU 410. Program RAM 440 contains the current software load for controlling the operation of RDU 30. Thus, RDU 30 may be reprogrammed so as to function in a different manner by simply loading new software into program RAM 440. It is not necessary to replace either the RDU 30 or any components therein. RAM 450 may also be included for storing temporary calculated data or input data during operation of RDU 30. As would be expected, RAM 450 and program RAM 440 may be one and the same memory structure rather than being distinct. Non-volatile storage may also be included for the purpose of storing data which are preferably retained when RDU 30 is powered off. Examples of such data is current handicaps for players registered with the course or course data including distances and suggested paces for each of the holes on the course.

Returning to the description of the components comprising RDU 30, a display processor 420 is also included for configuring data for display on the display areas of RDU 30. Display processor 420 functionality may alternatively be contained within CPU 410. Receiver 490 is also contained within RDU 30 and is connected to antenna 475. The combination of receiver 490 and antenna 475 serve to receive data which is transmitted by SST 80 to RDU 30. Receiver 490 communicates the data which it receives to CPU 410 for processing. Antenna 475 and receiver 490 are tuned to receive on the RF frequency or frequencies which are transmitted by SST 80. Finally, timer 415 is preferably included so as to perform timing functions necessary for pacing calculations and displays.

With the previous description of the components of RDU 30 in mind, the operation of RDU 30 when connected to an external computer is now described. As will be discussed in further detail below, one of the objects of the invention, collecting golf round data both during the round and following the round, is achieved by linking RDU 30 with one or more external computers. In a preferred embodiment of the present invention RDU 30 communicates with local computer 470 through an RF transmission. In such an embodiment, it is necessary to include transmitter 425 as a component of RDU 30. Transmitter 425 may share antenna 475 with receiver 490 such that antenna 475 functions to both receive and transmit information. Transmitter 425 must be capable of typically transmitting over a range of at least approximately 2 miles. This is necessary because local computer 470 will typically be located in a golf shop or club house or the like. In many cases this corresponds to a location near the 18th hole. Thus, in order for RDU 30 to communicate with local computer 470 wherein RDU 30 may be located anywhere on the golf course, a range of at least approximately 2 miles is suggested. RDU 30 may communicate according to a predetermined timing protocol or on a distinct frequency so as not to interfere with transmissions to or from other RDUs 30 or periodic transmissions may be manually made when a user depresses the transmit button 390 located on RDU 30.

An RF link as described above is preferably included so that dynamic, during play, data may be transmitted to local computer 470 in real time. Such data may include, for example (and as further described below) pacing information, real-time scoring information or messaging services. In the event such data is not required, i.e. only static, after play, data is required, RDU 30 may communicate with local computer 470 through a cabled link such as, for example an RS-232 cable. In this case, RDU 30 is preferably constructed so that it may be removed from the golf cart after play is completed, brought inside to the location of local computer 470 (e.g. to the golf shop) and connected thereto.

Finally, central computer 480 is also illustrated in FIG. 4. This computer is preferably selectively connected to local computer 470 for the communication of information as will be described below. Central computer 480 and local computer 470 preferably communicate over a standard telephone line using modems as is well known. Central computer 480 is typically a centrally located computer with an associated database wherein a large amount of data concerning individual golfers may be stored. An example of such data may be handicap data for players that is recorded centrally for reporting, handicap updating and the like. Central computer 470 may be owned and/or operated by a golf association charged with the responsibility of maintaining national handicaps for golfers.

It will be understood that the foregoing description of RDU 30 and its components is merely exemplary. The components may be selected to deviate from the aforementioned components while still accomplishing the same or similar functions without departing from the scope or spirit of the present invention.

Figure 5:
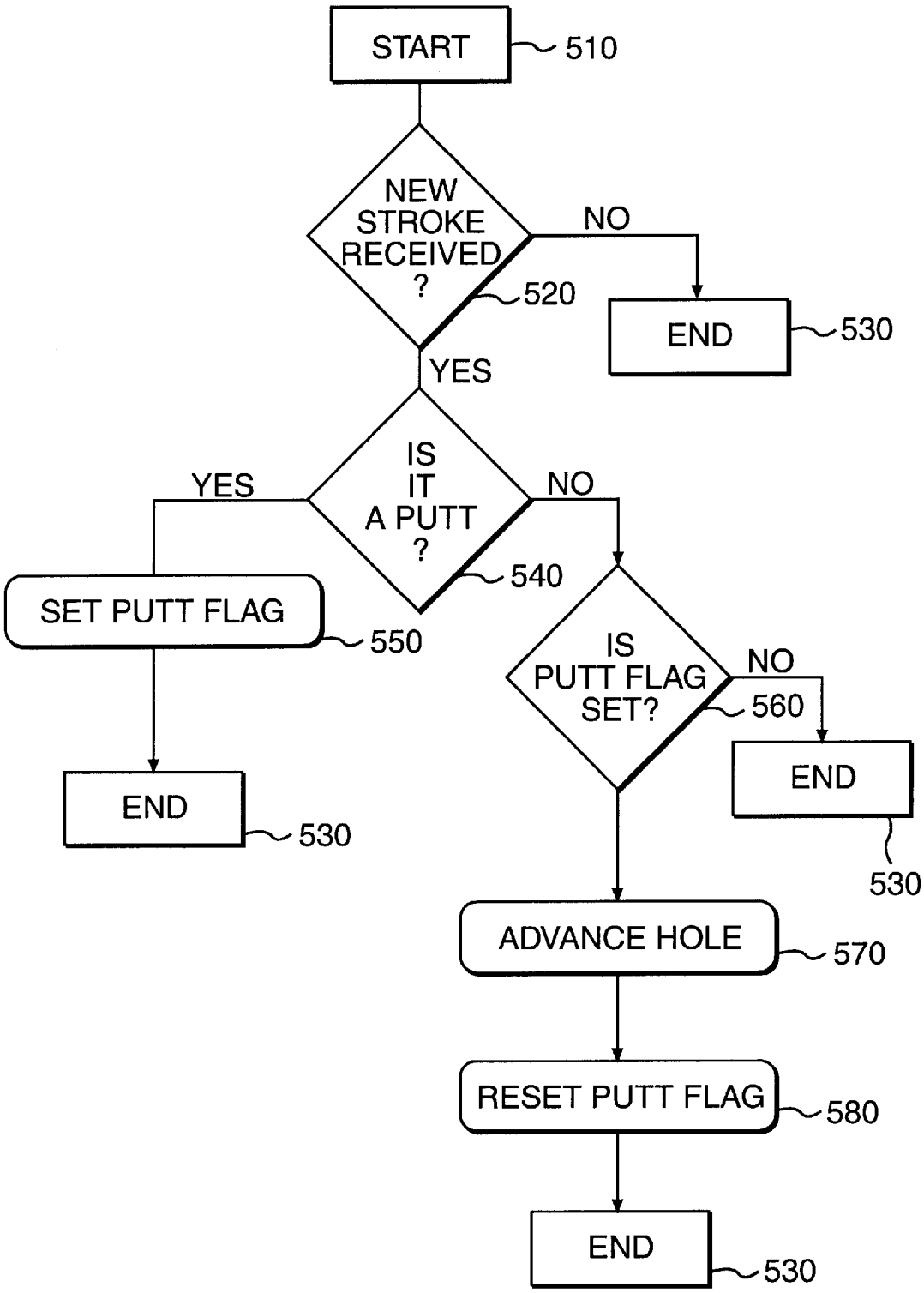
FIG. 5 is a flowchart illustrating the process for determining the hole being played by one or more golfers.

Referring now to FIG. 5, a description of the preferred process for advancing the On Hole display when players progress to a new hole is provided. The aforementioned process begins at step 510 and repeats while RDU 30 is powered on in the play mode. Next, at step 520, RDU 30 checks to see if a new stroke is received. In other words, the process checks to see if SST 80 has transmitted data indicating that golfer 50 has contacted ball 60 with club 65. If no new stroke is being received in this iteration, processing progresses to step 530 where the iteration terminates and then starts again at step 510. Alternatively, if a new stroke is detected at step 520 then RDU 30 determines, at step 540, if the stroke was a putt or a non-putt (i.e. drive, chip, fairway shot). As explained above, RDU 30 may make this determination by detecting different sonic patterns between a putt or a non-putt. If it is determined that this particular stroke is a putt, then processing continues at step 550. At this point a toggle flag (putt flag) is set to the true or "on" state. Processing then ends at step 530 and the loop begins again at start step 510.

Alternatively, at step 540 if it is determined by RDU 30 that the current stroke is not a putt, then at step 560, RDU 30 queries the putt flag to determine if it is set to true or "on". If not, then processing ends at step 530 and restarts at start step 510. Otherwise, if the putt flag is set to true or "on", then it is determined that the player has begun a new hole since he has last putted and is now taking a non putt stroke. As such, the on-hole data and display are incremented by 1 at step 570. Then, at step 580, the putt flag is reset to false or "off" and the process ends at step 530 and then restarts at start step 510. As Will be remembered from the discussion above, in case of a processing or detection error or if players decide to physically skip a hole, the on hole data and display may alternatively be manual advanced through the use of the advance hole button 330 located on RDU 30.

With the previous description in mind, exemplary functions of the GSS 10 will now be described. It will be understood that the functions are only examples of the capability of the GSS 10. Other functions may be easily be implemented based upon the disclosed structure of the GSS.

Real Time Score Data

As described above, the GSS 10 of the present invention may be employed to display the current scores of multiple golfers to those golfers during a round of golf The scores may be displayed in various modes as has been described. It is also possible with the present invention to transmit these real-time scores to local computer 470 or directly to a scoreboard, for example in tournament play, so that a golf marshall, course attendant or other interested party or parties (e.g. spectators) may be made aware of player's scores at all times during a round of golf without such interested party actually being physically present with golfers during play.

In order for this to be accomplished, data must be transmitted (both from SST 80 to RDU 30 and from RDU 30 to local computer 470) with tag data associated with players. Tag data may be assigned and maintained in local computer 470 as well as in non-volatile storage 460 in RDU 30 so that transmissions of data regarding a particular player are accompanied by a pre-assigned tag known both to RDU 30 and local computer 470. Tag data in a preferred embodiment of the invention may be a one or two byte sequence representative of a player's preassigned ID number. Thus, when player first begins play, the setup using RDU 30 includes a prompt for golfer 50 to enter his ID number which has been preassigned by the golf course staff In this way, local computer 470, upon receipt of any data, will know which player to associate the data with. Local computer 470 and RDUs 30 will preferably include a look-up table matching player's names with their tag data. As such, scoreboards or a video terminal or printer associated with local computer may display or print a player's name next to his score data.

RDU to RDU Communication

Another function which can be performed by GSS 10 is RDU to RDU communication. By using combinations of the transmit button 390 and other available keys on RDU 30, golfers may exchange information including their current scores, their current pace, the hole they are on and textual messages to other players having access to other RDUs. The transmission of textual messages will preferably require the use of a supplemental small keyboard as is known in the art and as may be attached as a peripheral to RDU 30. The communication between RDUs may occur on a broadcast basis, whereupon when a user depresses transmit button 390, all or some selected information will be broadcast to all RDUs in range. Alternatively, a user may select communication to only one or a specific set or RDUs. This may be accomplished through the use of an appropriate combination of the transmit button 390 and other keys located on RDU 30.

In an environment where RDU to RDU communication is desired, an additional display area is preferably included on RDU 30 for display of incoming messages or data. This display is preferably capable of displaying textual as well as numeric data.

The advantages of the above will be readily ascertained by golfers. For example, if one foursome desires to have its current scores made known to other groups of golfers or spectators, it may broadcast its score data. Alternatively, one group of golfers may query another through a textual message to find out data including scores or current hole. Upon receipt of this query, the receiving group may transmit the requested data either specifically to the requesting RDU or on a broadcast basis. Similarly, different groups may communicate regarding matters golf or otherwise during play using the RDU to RDU textual messaging capability.

Pacing Control

Yet another feature of GSS 10 according to the present invention involves pace control. This may be accomplished by allowing a golf marshall or other attendant to monitor golfer's pacing and present hole so as to schedule future tee times most appropriately. This data may also be used to permit a marshall to determine where a bottleneck may be occurring in play on the course and thus, address the situation appropriately, perhaps by directing one or more groups to play through. Pace control according to the above may be accomplished by transmitting pace data from RDU 30 to local computer 470 or a similar remote receiver located on a marshall's golf cart. Data transmitted in connection with pace control may include elapsed time on a particular hole, On Hole, average hole pace and overall elapsed time.

Another feature regarding pacing allows RDUs 30 to be preprogrammed with specific pace targets. Thus when RDU 30 detects a play pace slower than the target pace, audible or visual warnings may be provided to players. The slow play situation may further be reported back to local computer 470 for appropriate action.

Messaging Services

As discussed above, it is possible to provide a display area on RDU 30 to permit textual messaging between RDUs. It is also possible to use this same capability to allow communication between an RDU 30 and local computer 470. In this way, messages called in to the clubhouse directed to a particular player or players on the golf course may be relayed by entering the message into local computer 470 for transmission to a specific RDU perhaps including an audible tone to alert a player that a message has been received. Alternatively, communication may occur in reverse, allowing a golfer to send a message to the clubhouse for whatever purpose. Finally, the clubhouse may, via local computer 470, broadcast a message to all RDUs so as to inform all golfers regarding a particular matter. For example, the golf course administration may inform all golfers regarding such matter as course closings, hazards, local rules, ongoing course maintenance or the drink special at the clubhouse.

Handicap and Statistical Maintenance Services

GSS 10 may further be employed to perform a variety of statistical services in connection with play at a particular course. For example, when data is transmitted from RDU 30 to local computer 470 both during play and after a round, that data may be used to generate statistical information regarding the course and play thereon. For example, data may be generated regarding average number of strokes on each hole, average number of strokes for a round of 18 holes on the course, average number of putts on a hole or during a round, or average number of non-putts on a hole or during a round or other necessary or desirable data that may be calculated from the data gathered by GSS 10. All this data may be tabulated and printed or displayed for interest or to adjust pin placements or course conditions or both.

GSS 10 may also be used to automatically calculate, update and display player handicaps. Thus, since each player is assigned a unique player ID, each time player plays a new handicap may be calculated or calculation may be done on a period basis. In either case, no manual input is necessary since all scoring data is automatically provided to the system through play.

While the principles of the invention have been described in various illustrative embodiments, it will be apparent to those skilled in the art that various modifications or substitutions in structure, arrangement, proportions, layout, materials or components may be made without departing from the scope or spirit of the present invention. Having thus described my invention and the principles and operation pertaining thereto,

I claim:

1. A golf stroke counting device comprising:

stroke detection means for determining when a golf stroke has been taken;

score processing means for receiving data from said stroke detection means and processing at least one player score based thereon; and display means for displaying said at least one player score.

2. The golf stroke counting device of claim 1 wherein said stroke detection means comprises a sound detector located proximate to the location of said golf stroke.

3. The golf stroke counting device of claim 1 wherein said stroke detection means communicates with said score processing means through an RF transmission.

4. The golf stroke counting device of claim 1 further comprising at least one additional stroke detection means, each of said stroke detection means communicating with a single score processing means.

5. The golf stroke counting device of claim 4 wherein said communication between each said score processing means and said single stroke detection means includes tag data for communicating the identity of each said stroke detection means to said score processing means.

6. A method for counting the number of strokes taken by a golfer comprising the steps of:

detecting when said golfer takes a stroke;

transmitting data representing said stroke to a receiver/display unit;

processing said data representing said stroke to determine the total number of strokes taken by said golfer; and displaying said total number of strokes taken by said golfer.

7. The method of claim 6 wherein said step of detecting when said golfer takes a stroke is accomplished using a sound detector.

8. The method of claim 6 further comprising the step of adjusting said number of strokes taken by a golfer based upon said golfer's handicap.

9. A golf data system for automatically tracking a golfer's score and displaying said golfer's score and information generated from said golfer's score comprising:

a sensor, said sensor detecting when said golfer makes contact with a golf ball using a golf club;

a transmitter operably connected to said sensor, said transmitter transmitting stroke data respecting said golfer making contact with golf ball;

a receiver, said receiver receiving said stroke data from said transmitter;

a golf data processor, said golf data processor processing said stroke data for display; and a display unit for receiving said processed stroke data and displaying the total number of strokes taken by said golfer during a predetermined timeframe.

10. The golf data system of claim 9 wherein said sensor comprises a sound sensor.

11. The golf data system of claim 9 wherein said golf data system further comprises a timer and wherein said golf data system processes said stroke data in order to calculate and display pace information.

12. The golf data system of claim 9 wherein said golf data system processes said stroke data in order to calculate and display on-hole information.

13. The golf data system of claim 9 wherein said golf data system processes said stroke data in order to calculate and display score information.

14. The golf data system of claim 9 further comprising a local computer, said local computer located in a central location and communicating with at least one golf data processor, said local computer centrally storing golf data generated by at least one round of golf.

15. The golf data system of claim 14 wherein said local computer stores golf data attributable to rounds of golf played at a single golf course.

16. The golf data system of claim 15 further comprising a central computer, said central computer communicating with at least one local computer, said central computer centrally storing data associated with rounds of golf played at a plurality of golf courses.

17. The golf data system of claim 9, said golf data system comprising a plurality of sensors and a plurality of transmitters, each of said sensors and transmitters generating and transmitting respectively, unique tag data, said tag data identifying the transmitter transmitting said tag data.

18. The golf data system of claim 9, said golf data system comprising a plurality of sensors and a plurality of transmitters, each of said sensors and transmitters transmitting on a unique RF frequency, said unique RF frequency being mapped to the transmitter transmitting on said unique RF frequency.

19. The golf system of claim 9, said golf data system comprising a plurality of golf data processors, each of said golf data processors communicating with other golf data processors in said golf data system.

20. The golf data system of claim 19 wherein said golf data processors communicate stroke data to and from each other.

* * * * *